United States Patent [19]

Teich et al.

[11] 4,454,403

[45] Jun. 12, 1984

[54] MICROWAVE HEATING METHOD AND APPARATUS

[75] Inventors: Wesley W. Teich, Wayland; Kenneth W. Dudley, Sudbury, both of Mass.

[73] Assignee: Raytheon Company, Lexington, Mass.

[21] Appl. No.: 211,975

[22] Filed: Dec. 1, 1980

[51] Int. Cl.[3] ..... H05B 6/64

[52] U.S. Cl. ..... 219/10.55 E; 219/10.55 F; 219/10.55 M; 99/DIG. 14; 126/390; 426/243

[58] Field of Search ..... 219/10.55 R, 10.55 E, 219/10.55 M, 10.55 F; 426/241, 243, 107; 99/451, DIG. 14; 126/390

[56] References Cited

U.S. PATENT DOCUMENTS

| | | | |
|---|---|---|---|
| 2,830,162 | 4/1958 | Copson et al. | 219/10.55 E |
| 3,591,751 | 7/1971 | Goltsos | 219/10.55 |
| 3,701,872 | 10/1972 | Levinson | 219/10.55 |
| 3,731,103 | 5/1973 | Levinson | 219/10.55 |
| 3,783,220 | 1/1974 | Tanizaki | 219/10.55 |
| 3,941,967 | 3/1976 | Sumi et al. | 219/10.55 E |
| 3,941,968 | 3/1976 | MacMaster et al. | 219/10.55 E |
| 3,946,188 | 3/1976 | Derby | 219/10.55 E |
| 4,003,840 | 1/1977 | Ishino et al. | 219/10.55 D |
| 4,027,132 | 5/1977 | Levinson | 219/10.55 F |
| 4,190,757 | 2/1980 | Turpin et al. | 219/10.55 E |
| 4,266,108 | 5/1981 | Anderson et al. | 219/10.55 E |
| 4,267,420 | 5/1981 | Brastad | 219/10.55 F |
| 4,362,917 | 12/1982 | Freedman et al. | 219/10.55 E |
| 4,371,742 | 2/1983 | Manly | 174/35 MS |

*Primary Examiner*—C. C. Shaw
*Assistant Examiner*—Philip H. Leung
*Attorney, Agent, or Firm*—William R. Clark; Joseph D. Pannone

[57] ABSTRACT

A microwave cooking container comprising a conductive layer to which is bonded a layer of material having high hysteresis loss at microwave frequencies. When subjected to microwave radiation the hysteresis loss material heats to its Curie point where its loss is substantially reduced while the dielectric loss is minimized by being effectively shielded by its proximity to the surface of the conductive layer. The conductive layer may be a metal dish cover whose outer surface supports a plastic bonded ferrite and whose inner surface contacts a food body in a metal dish. The Curie point region of the ferrite is lower than the degradation temperature of the plastic. Overlapping the walls of the dish and cover forms a microwave seal to prevent microwave heating of the dish contents.

8 Claims, 9 Drawing Figures

FIG. 3
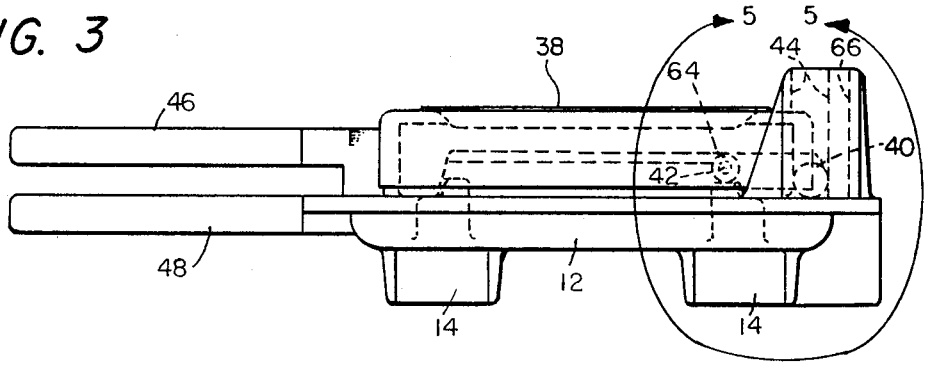
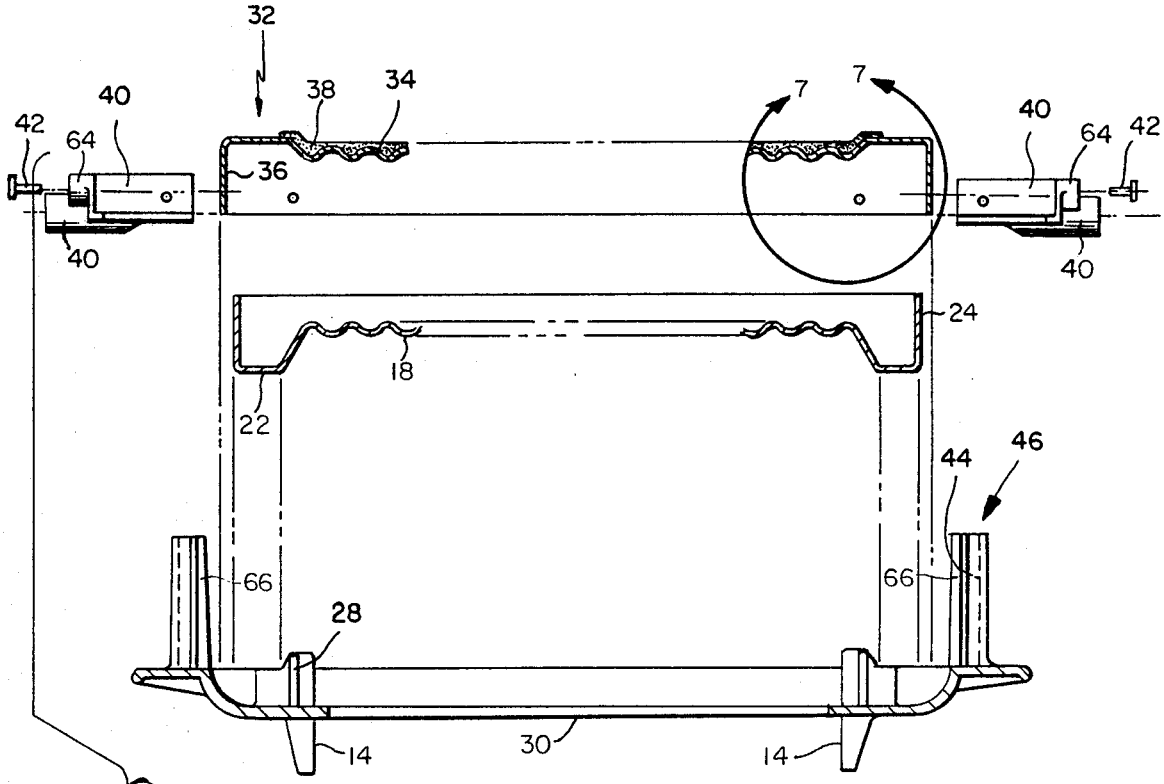
FIG. 4

MICROWAVE HEATING METHOD AND APPARATUS

BACKGROUND OF THE INVENTION

Dishes or grills for browning food bodies in microwave ovens have generally used resistive material on the surface of the dish such as a thin metal or metal oxide coating which absorbs microwave energy. However, such structures do not limit such absorbing of microwave energy at any particular temperature but continue to increase such absorbing with increases in temperature.

Attempts to produce automatic temperature limiting by fabricating a dish of ferrite materials as disclosed in U.S. Pat. No. 2,830,162 have not been satisfactory since the dielectric loss factor has increased with temperature and the dish has been prone to cracking.

SUMMARY OF THE INVENTION

In accordance with this invention there is provided an appliance for use in a microwave oven in which a body having high electrical conductivity and good thermal conductivity such as metal is coated with a relatively thin layer of material having high magnetic permeability and a large hysteresis loss characteristic below its Curie point region. More specifically, the conductive body may be coated with a layer of material comprising a ferromagnetic metal oxide having a thickness which is substantially less than a quarter wavelength of the free space wavelength of microwave energy to which the body is to be subjected. For example, if the body is to be positioned in a microwave oven having a frequency of 2.45 KMH, the layer of ferrite material would be substantially less than one inch thick and preferably substantially entirely within one-quarter inch of the surface of said high electrical conductivity body. Since a radiated microwave, for example, in an oven impinging on a metal surface, generates substantial currents in the surface while reflecting the wave, such currents produce strong local magnetic fields which couple strongly to ferromagnetic materials. Hence microwave energy will be absorbed if the ferrite materials in the coating have a large hysteresis loss characteristic. However, since the electric field component of the radiated waved is sharpy reduced as it approaches a conductive surface even at angles other than perpenducular to the surface due to the short circuiting effect of the surface, the dielectric loss in the ferrite material or bonding medium is low.

This invention discloses the discovery that as a ferrite material coating on a conductive surface is heated toward its Curie point, it absorbs microwave energy predominantly by hysteresis loss, and the dielectris loss which increases with temperature is substantially minimized by being shielded from the microwave energy due to its proximity to the conductive surface.

This invention further discloses that the conductive member may be a structural body such as an aluminum dish cover which provides substantially the entire structural support for the ferrite layer so that the ferrite layer may be of relatively weak or brittle material and may be small regions of ferrite bonded to the layer of metal so that the thermal expansion of the aluminum with increases in temperature need not be matched to the thermal expansion of the ferrite. Thus, the ferrite material may be selected for its particular Curie point and loss characteristics rather than its structural characteristics.

Further in accordance with this invention, the ferrite may comprise small particles of material bonded together and to the conductive body by a bonding medium which will withstand temperatures above the Curie point of the ferrite. For example, if a ferrite having a Curie point region of 500° F. to 550° F. is selected, a bonding medium, such as epoxy cement, which will withstand temperatures in excess of 550° F., may be used to bond a layer of ferrite particles to an aluminum dish or grill. The epoxy cement provides sufficient resiliency or plasticity that it will not crack when the aluminum body, which has a large temperature coefficient of expansion, is heated from room temperature to 525° F. In addition, the thermal energy is generated in the ferrite particles by hysteresis loss and is transferred by conduction through the bonding medium and the metal dish cover to the surface of a food body contacting the inner surface of the cover.

In accordance with this invention, the surface of the cover adjacent the food body is preferably coated with a layer of material having relatively good black body radiation characteristics. As a result, with temperatures of, for example, 300°–500° F., substantial browning of a food body such as meat may occur.

This invention further contemplates that the food body may be partially or completely shielded from microwave radiation so that the primary heating of the body is by infrared radiation from the utensil or contact conduction therefrom. More specifically, the food body may be supported in a metal dish having a metal cover whose metal sides overlap the metal sides of the dish, spaced therefrom, to form a microwave seal. Thus, juices and fats in the dish are shielded from microwave energy in the oven and hence leave substantially all the microwave energy for use in heating the ferrite.

In addition, it is contemplated that in accordance with another aspect of the invention, air may be circulated past the container while it is heated by thermal energy absorbed by the ferrite coating and transferred through a metal cover contacting the food body.

BRIEF DESCRIPTION OF THE DRAWINGS

Other and further objects and advantages of the invention will be apparent as the description thereof progresses, reference being had to the accompanying drawings wherein:

FIG. 3 illustrates a side elevation view of the microwave appliance illustrated in FIGS. 1 and 2;

FIG. 4 illustrates an exploded sectional view of portions of the microwave appliance of FIGS. 1–3 taken along line 4—4 of FIG. 1;

DESCRIPTION OF THE PREFERRED EMBODIMENT

Figure 1:
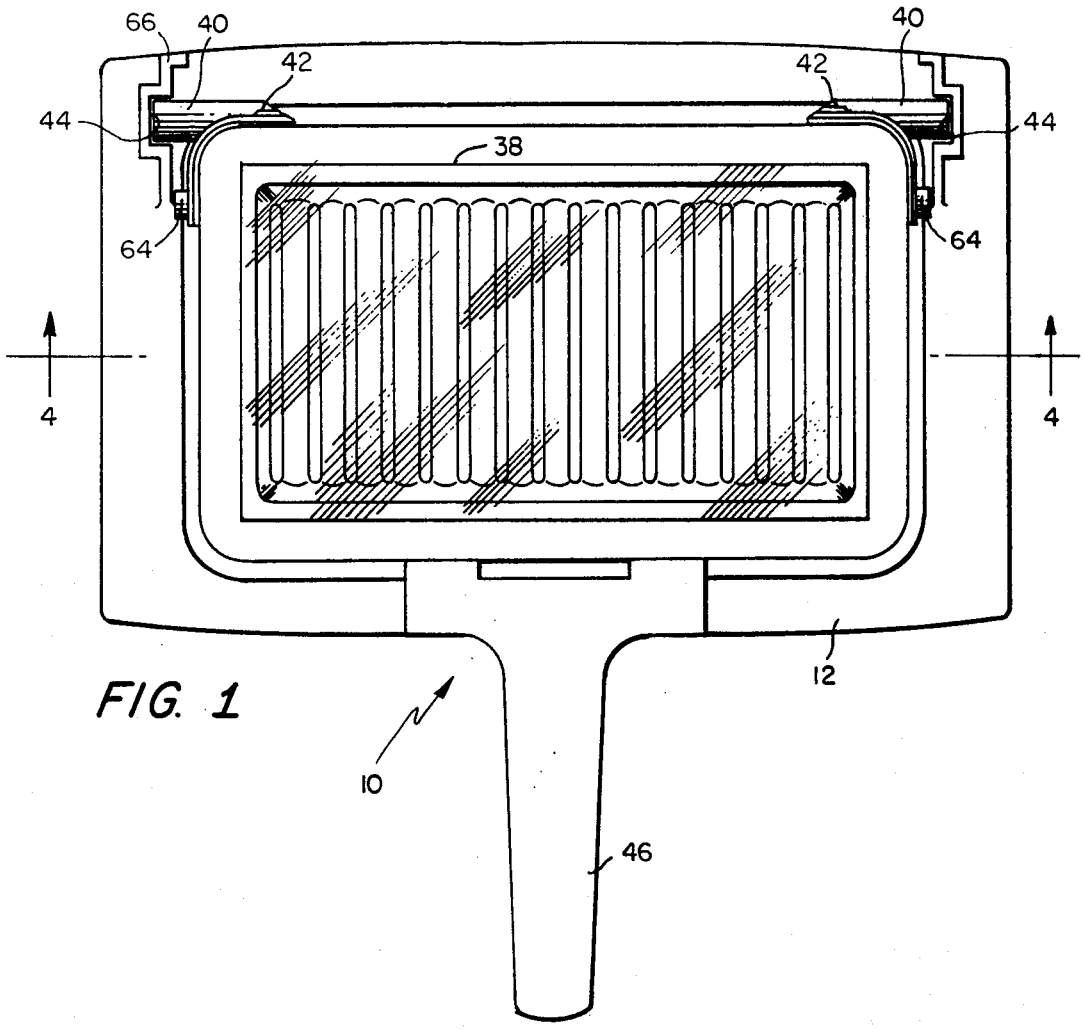
FIG. 1 illustrates a top plan view of a microwave appliance embodying the invention.
Figure 2:
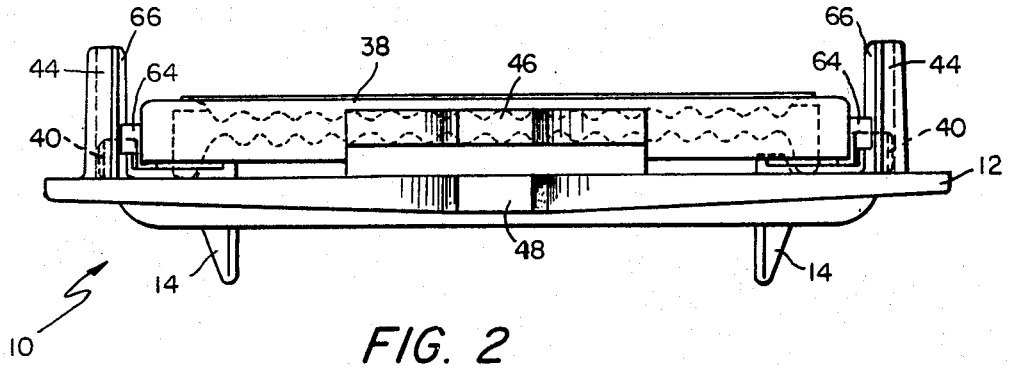
FIG. 2 illustrates a front elevation view of the microwave appliance illustrated in FIG. 1.
Figure 8:
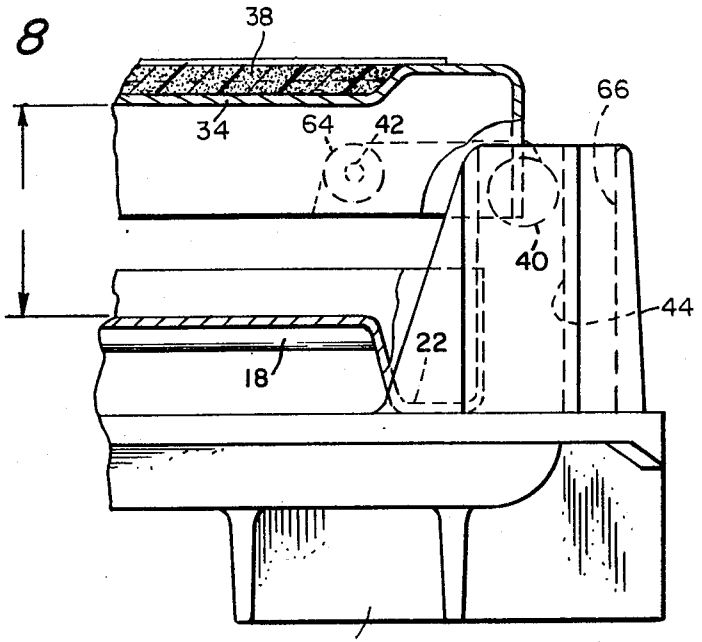
FIG. 8 illustrates the same detail as FIG. 5 but with the cover elevated to accomodate a large food body and with the dish and cover in cross-section.
Figure 7:
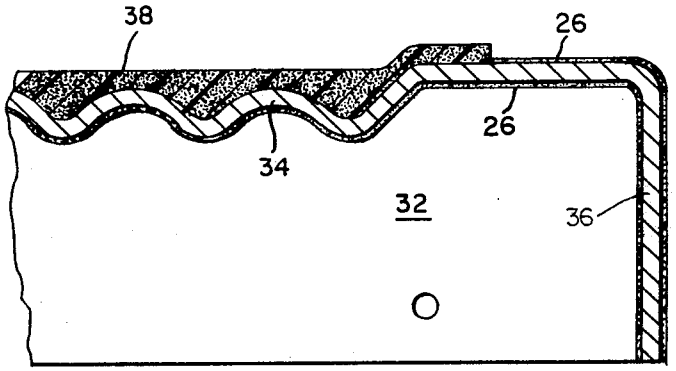
FIG. 7 illustrates a detail of the cover of FIG. 6 taken along line 7—7 of FIG. 6.
Figure 5:
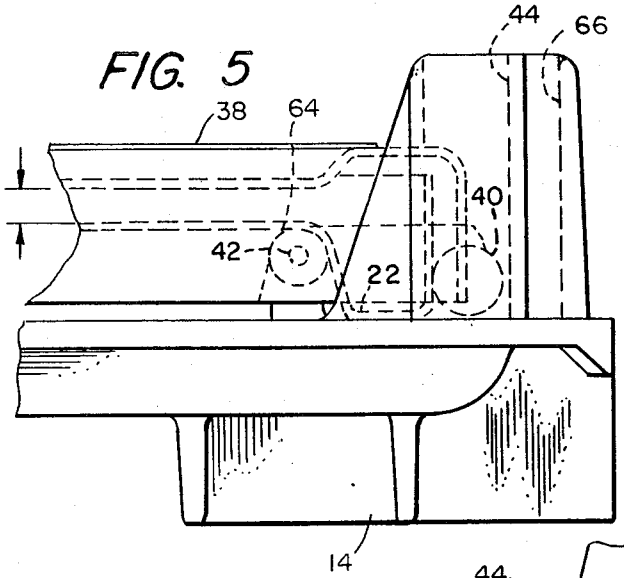
FIG. 5 illustrates a detailed view of a portion of the hinge used in the microwave appliance of FIGS. 1–3 taken along line 5—5 of FIG. 4 with the microwave appliance cover closed.
Figure 6:
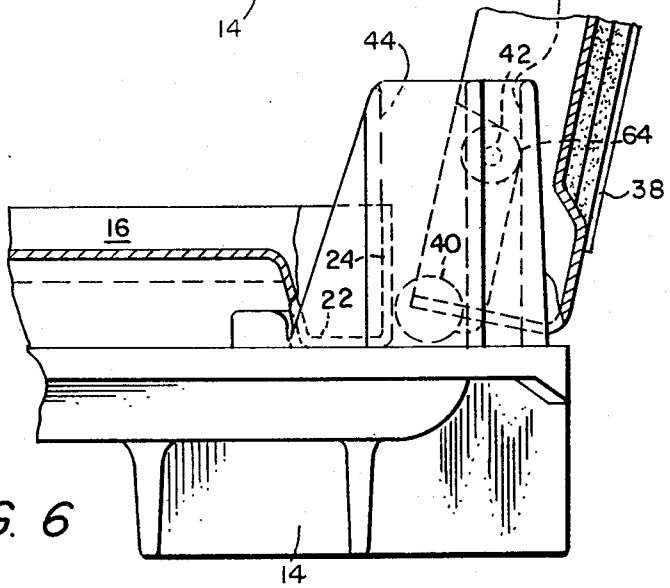
FIG. 6 illustrates the same detail as FIG. 5 but with the microwave appliance cover open and with the cover and dish shown in cross-section.

Referring now to FIGS. 1-8, there is shown an appliance 10 for cooking a food body such as a beef steak in a microwave oven. The appliance 10 comprises a base portion 12 of thermally insulating material such as high temperature plastic formed, for example, by molding in accordance with well-known practice. Four legs 14 extend downwardly and are molded integrally with base portion 12. Base portion 12 supports a food container dish 16 made, for example, of metal and having a rib-like members 18 forming a corregated region in its lower surface on which a food body 20 may rest. Preferably, dish 16 is made of thin metal such as aluminum and the rib-like members in the bottom serve the added function of stiffening the dish structure. Dish 16 also has a depressed trough region 22 formed around the periphery of the ribbed bottom of the dish with the bottom of the trough being substantially below the bottoms of the ribbed grooves so that juices and fats which drain from the food body 20 during heating can drain along the grooves between the ribs 18 and into the trough 22. A perimeter wall 24 of the dish extends around the periphery of the dish from the bottom of the trough region to a point above the ribs 18 so that juices and fats from the food body will be drained away from the food body to the trough region 22 where they will no longer be heated during the cooking process thereby eliminating their absorption of additional heat from the food body.

The surfaces of dish 16 are preferably coated with a nonstick layer 26 of high temperature plastic such as Teflon in accordance with well-known practice.

In order to minimize the transfer of heat from dish 16 to the base 12, the dish 16 contacts the base 12 only in the regions of four small bosses 28 spaced around the periphery of the dish and formed integrally with the molded base 12. Bosses 28 contact the dish 16 as shown at the bottoms of the trough 22 and at the sloping interior peripheral wall of the trough 22 so that such points of contact are separated from the ribbed members 18 supporting the food body by substantial distances of the thin metal dish 16. These substantial distances act as a thermal choke to further prevent the heat from the dish from substantially escaping into the base portion 12 to thereby inhibit cooling of the food body and to prevent the base portion from overheating. In addition, the region of the base portion below the ribbed dish members 18 has a substantial aperture 30 so that air may circulate past the regions of the base 12 closest to the dish to ensure that no portion of the plastic base portion 12 exceeds a temperature of, for example, 200° C. above which the base portion might become weakened or in time deteriorate.

A cover member 32, formed of thin metal such as aluminum, has ribs 34 forming a corregated region therein above the ribbed members 18 in dish 16. Ribs 34 preferably engage the upper surface of the food body 20 during cooking.

In accordance with this invention, cover 32 has a peripheral metal wall 36 extending substantially vertically downwardly from its upper surface outside, and spaced from, the metal wall 24 of dish 16. Wall 36 forms an overlapping region with wall 24 which acts as a microwave seal so that steam and other vapors may exit from the dish through the space between the walls 36 and 24 while microwave energy is substantially prevented from entering the dish.

A flexible plastic bonded ferrite microwave absorbing body 38 is supported on top of cover 32 contacting the surface of the corregated region of ribs 34. Region 38 acts as a heating element by absorbing microwave energy when the appliance 10 is subjected to microwave fields, for example, in a microwave oven and the thermal energy generated thereby is transferred from ferrite region 38 through the ribbed region 34 of cover 32 to cook the food body 20 in contact with the cover 32.

In accordance with this invention, the ferrite region 38 is formed of particles of a standard ferrite, such as the ferrite $Q_1$ supplied by Indiana General imbedded in a flexible high temperature plastic so that as the element 38 heats and the aluminum ribbed regions of the cover 32 heat, cracking will not occur of the ferrite region 38 due to stetching of the plastic. Preferably, the ferrite material is chosen so that the center of its Curie point region is between 250° C. and 350° C. so that microwave energy absorption by the ferrite will be substantially reduced before the plastic binder material of heater element 38 reaches a temperature substantially in excess of 300° C. As used throughout the specification and claims, the term "Curie point region" is intended to mean the temperature range in which a ferrite has its value of magnetic permeability reduced from 90% of its room temperature value to 50% of its room temperature value as the ferrite is heated from room temperature through said temperature range. Thus, in a conventional microwave oven supplying a maximum of 800 watts of microwave energy, a surface of ferrite element 38 exposed to the microwave energy of, for example, 4½ inches by 8 inches will not reach a temperature in excess of 500°-550° F. when heated in a microwave oven. This invention takes advantage of the fact that ferrite material responds to the high magnetic fields associated with the reflective surface of the cover 32 to couple the microwave energy into the ferrite 38. This effect is at a maximum in the low impedance region adjacent the highly conductive surface of the cover 32. The flexible plastic binder of the ferrite heating element 38 being very close to the highly conductive surface, couples relatively poorly to the electric field of the microwave energy adjacent the surface of the cover 32 since this electric field is weak adjacent the highly conductive surface. Thus, flexible high temperature plastic whose degradation temperature is above 600° F., such as the commercially available silicone based plastic SILASTIC, can be used to bond the ferrite particles together and to bond to the cover 32.

For preferred results, this invention teaches that the distance of the exposed surface of the ferrite body 38 is preferably within a distance of ⅛ of an inch to ⅜ of an inch from the closest metal surface of the cover 32. Thinner ferrite bodies 38 do not provide enough ferrite material to efficiently absorb all the microwave energy into thermal energy whereas thicker ferrite bodies 38 have portions of the ferrite body sufficiently far from the conductive surfaces of the cover that substantially dielectric heating of the flexible plastic binder in the body 38 occurs.

The cover 32 has two plastic pivots 40 attached to the exterior rear corners thereof, for example, by metal rivots 42 or by any other desired means such as gluing or plastic bonding. Since the pivots 40 are separated from the ferrite heating element 38 by substantial distances of the thin metal of the cover 32, they do not approach the temperature of the ferrite material 38 due to the thermal choking action of the thin metal regions of the cover 32. Plastic pivots 40 pivotally slide in grooves 44 vertically molded into projections formed integrally with and up standing from the rear corners of base 12. Movement of cover 32 is thus restricted by the action of pivots 40 in grooves 44 to vertical movement and to pivoting motion for opening the cover 32 to expose the food body 20 and the wall 36 of cover 32 is maintained in spaced relationship to the wall 24 of dish 16. Preferably, such spacing between the walls 24 and 36 is substantially less than a quarter wavelength of the 2.45 KMH microwave energy conventionally used in domestic microwave ovens. For example, as shown in the present dish, a spacing of approximately ⅜ of an inch is formed between the walls. Pivots 40 are also positioned so that when no food body is in the dish, they will support the cover 32 by engaging the bottoms of the grooves 44.

A handle 46 is attached to the front region of the cover wall above a similar handle 48 molded integrally with base 12 and supports the front of cover 32 from the base 12 so that the upper edge of dish wall 24 does not touch the interior of cover 32. Otherwise, deterioration by abrasion of the dish and cover by microwave energy arcing might occur.

Figure 9:
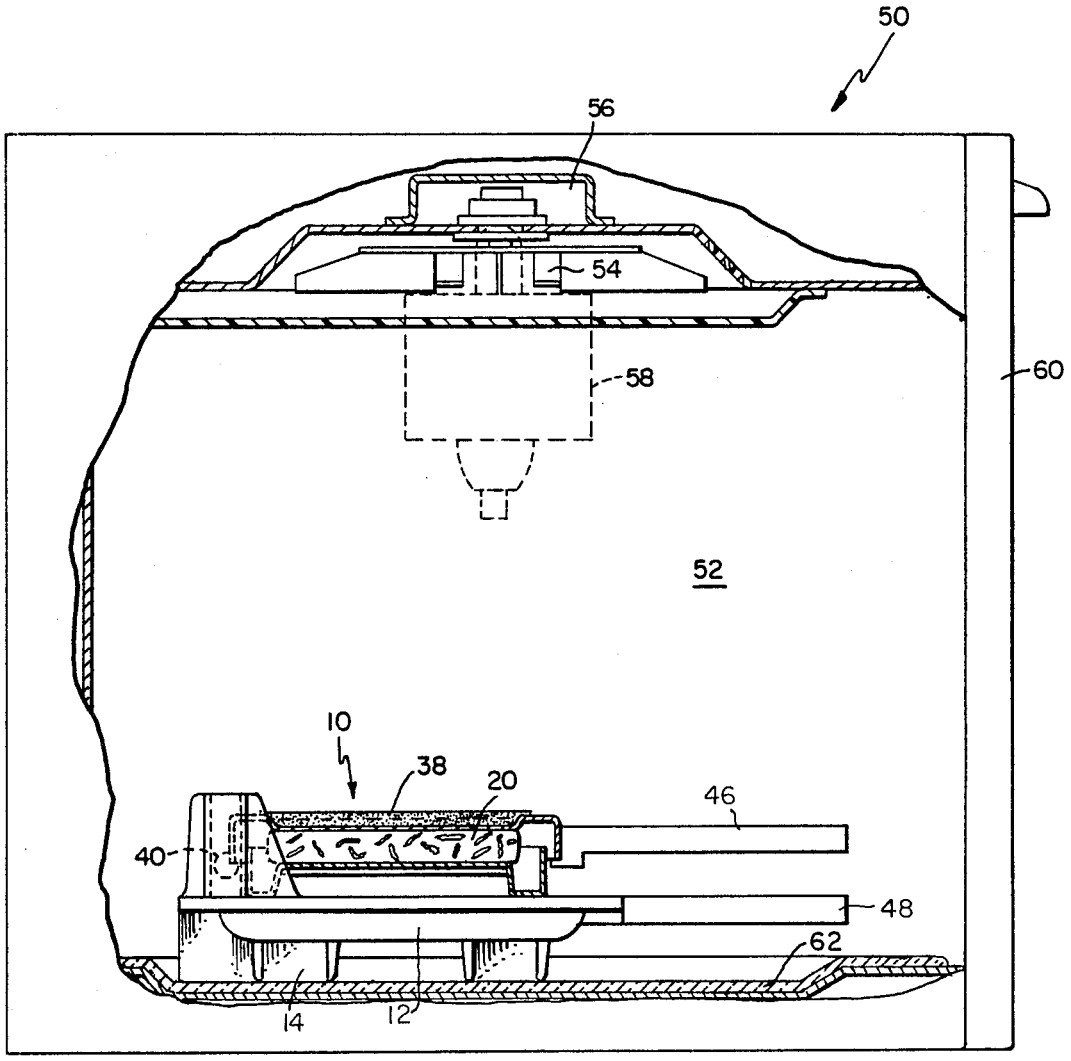
FIG. 9 illustrates the dish of FIGS. 1-3 being used in a microwave oven to heat a food body in accordance with this invention.

Referring now to FIG. 9, there is disclosed the dish illustrated in FIGS. 1–8 in a microwave oven 50. Microwave oven 50 may be of any desired type such as the commercially available domestic microwave oven having a heating cavity 52 supplied with microwave energy through an air driven rotating radiator 54 from a waveguide 56 coupled to magnetron 58. Microwave oven 50 may have conventional timing controls in accordance with well-known practice. A door 60 swings down to provide access to the enclosure 52 so that the microwave appliance 10 may be inserted in the oven and removed therefrom.

In accordance with this invention, direct radiation from a primary radiator 54 toward the ferrite heating element provides efficient coupling of microwave energy into the ferrite heating element 38 when the appliance 10 is first inserted into the enclosure 52. However, when the desired temperature of 500°–550° F. is reached by the ferrite heating element 38, microwave energy is at least partially reflected from the metal surface of the cover 32 beneath the ferrite heating element toward the walls and top of the oven enclosure where it is absorbed or reflected toward the bottom of the oven to be absorbed by a tray 62 of dielectric material such as Pyrex conventionally found in domestic microwave ovens. Thus, the coupling of microwave energy to the appliance is varied dependent on the temperature of the ferrite material 38 to provide automatic thermostatic control of the appliance 10. In addition, since the ferrite absorbs less material as the temperature above 500° F. is reached by the ferrite 38, the tolerance to which the timer can be set to produce a given degree of cooking of a food body is increased. Also, cooking time of a food body varies less between different appliances of similar design having variations due to production tolerances, and varies less between different microwave ovens than would occur without the thermal limiting effect of the ferrite. Also, because the food body is substantially completely shielded from microwave energy, differences in cooking time due to microwave energy absorbing rates by the food body are substantially eliminated.

Different maximum temperatures of the ferrite body may be achieved by using different percentages of ferrite material in the ferrite body 38. However, a preferred percentage in the range between 75 and 80% by weight of the ferrite body 38 is ferrite particles with the remainder being high temperature flexible plastic binder which binds the particles together and is in turn bonded to the upper surface of the cover 32.

DESCRIPTION OF THE PREFERRED MODE OF OPERATION OF THE INVENTION

In operation, a food body such as a beef steak 20 is placed on the rib-like members 18 in the dish 16 and the dish 16 is placed on base portion 12. The cover 32 is then placed on the dish 16 with the plastic pivots 40 attached to the cover 32 in the grooves 44 in the base portions and the cover 32 is closed over the dish 16 so that substantial portions of the walls 24 and 36 overlap while the cover 32 rests on food body 20.

The microwave appliance 10 is then placed in the oven 50 and the door 60 is closed. An appropriate time such as 5 to 10 minutes is set on the microwave oven controls with the oven power setting preferably at full power. The oven start button is then actuated and microwave energy is supplied from the magnetron 58 through the waveguide 56 and through the aperture between the waveguide and oven wall in which the plastic bearing of radiator 54 is supported. A conductive stub (not shown) electrically connected to the conductive portions of radiator 54 extends into the waveguide 56 to couple microwave energy from the waveguide 56 into the enclosure 52 in accordance with well-known practice.

Microwave energy in enclosure 52 impinges on ferrite layer 38 bonded to the top of cover 32 where it is converted to thermal energy which is transferred by conduction through the metal cover 32. Thermal energy is then transferred to the food body 20 by conduction and/or radiation to heat and brown the surface of the food body. The browning will appear more predominantly as a series of bars formed by the points of contact of the cover at the bottoms of the ribs 34.

Vapors given off by the food body 20 pass through the spaces between the points of contact of the food body 20 with the cover 32 and out of the appliance 10 through the spaces between the walls 24 and 36. Liquids such as fats and juices pass down the sides of the food body as well as along the spaces between the dish ribs 18 and the food body into the trough 22 where they cease to be heated by conduction from the heating element 38 and are shielded from exposure to the microwave energy by the metal surfaces of the dish 16 and cover 32.

When the present time has elapsed, the door 60 is opened and the appliance 10 pulled out from the oven by the base handle 48. The cover is swung open by lifting the cover handle 46 so that the cover pivots into a substantially vertical position on the pivots 40. Preferably, plastic pivots 40 also have molded therein boss stop regions 64 which engage stop portions 66 molded in base 12 adjacent grooves 44 to retain the cover in a slightly leaned back vertical position. The food body 20 may be then turned over so that the unheated portion resting on ribs 18 may contact the ribs 34 in the cover. The cover 32 is then closed and the appliance 10 is returned to the oven 50. Microwave energy is then supplied to the oven for a shorter period such as 3 to 8 minutes to brown and cook the side of the food body now adjacent the cover 32.

Thus, it may be seen that a food body may be cooked and/or browned on one or both sides to any desired degree in accordance with the invention by simply setting the timing of the microwave oven to supply the desired total amount of energy to the appliance 10. The appliance may be used in general with any microwave oven without overheating and with good results.

This completes the description of the embodiments of the invention illustrated herein. However, many modifications thereof will be apparent to persons skilled in the art without departing from the sprit and scope of the invention. For example, different sizes and thicknesses of food bodies as well as different types of food bodies may be cooked and browned in the microwave appliance. More specifically, sausages, fish, poultry and other similar food products may be cooked with microwave energy being first converted by the ferrite heating element to thermal energy which is then transferred by conduction to the interior of the appliance. Different kinds of ferrite materials may be used for the heating element and the shape of the plastic base may be varied. In addition, materials other than plastic can be used for the base and handles. Accordingly, it is desired that this invention be not limited to the specific embodiments of the invention illustrated herein except as defined by the appended claims.

What is claimed is:

1. A microwave heating appliance comprising:
a rigid metal sheet having first and second substantially parallel surfaces; and
a layer of silicone having ferrite particulate dispersed therein, said layer being adhered to said first surface for producing heat by absorption of microwave energy, said heat conducting through said metal sheet in sufficient magnitude to cook a food body positioned adjacent to said second surface.

2. The appliance in accordance with claim 1 wherein:
said metal sheet comprises aluminum having a corrugated region for contacting said body.

3. The appliance in accordance with claim 1 wherein:
said silicon has a degradation temperature above the Curie point region of said ferrite particulate.

4. The appliance in accordance with claim 1
further comprising a non-stick layer adhered to said second surface for preventing said food body from sticking to said second surface.

5. The appliance in accordance with claim 1 wherein:
said layer has a thickness of less than a tenth of a wavelength at the frequency of approximately 2450 MHz.

6. A microwave heating appliance comprising:
a food container having a metallic bottom and metallic walls;
a cover for said container comprising an electrically conductive rigid top and electrically conductive rigid walls surrounding at least the upper portions of said container walls for substantially shielding a food body contacting an inner wall of said cover in said container from microwave energy supplied to said appliance;
a layer comprising ferrite particulate dispersed in silicone adhered to the outer surface of said cover for producing heat by absorbing said microwave energy; and
portions of said heat produced by said layer conducting through said cover in sufficient magnitude to cook said food body.

7. The microwave heating appliance in accordance with claim 6 wherein:
said layer has a thickness of less than an eighth wavelength of said microwave energy at a frequency of approximately 2450 MHz.

8. The method of heating a food body using microwave energy, comprising the steps of:
positioning a food body adjacent to a first surface of a rigid metal sheet;
radiating microwave energy to a silicone layer adhered to the second surface of said sheet, said silicone layer having ferrite particulate dispersed therein, said ferrite particulate heating in the presence of said energy; and
conducting a portion of said heat through said metal sheet in sufficient magnitude to cook said food body.

* * * * *